US007216765B2

(12) United States Patent
Markert et al.

(10) Patent No.: US 7,216,765 B2
(45) Date of Patent: May 15, 2007

(54) SPACER AND SHOCK-ABSORBER TYPE ANGLEBOARD EDGE OR CORNER PROTECTOR

(75) Inventors: Gary G. Markert, Hawthorn Woods, IL (US); Douglas E. Smith, Milford, OH (US); Elton Beyer, Alexandria, KY (US)

(73) Assignee: Illinois Tool Works Inc., Glenview, IL (US)

( * ) Notice: Subject to any disclaimer, the term of this patent is extended or adjusted under 35 U.S.C. 154(b) by 129 days.

(21) Appl. No.: 11/060,487

(22) Filed: Feb. 18, 2005

(65) Prior Publication Data

US 2006/0186017 A1 Aug. 24, 2006

(51) Int. Cl.
*B65D 81/02* (2006.01)
*A47B 95/00* (2006.01)

(52) U.S. Cl. ..... 206/586; 206/320; 206/453; 248/345.1

(58) Field of Classification Search ..... 206/586, 206/320, 453; 248/345.1; 52/287.1, 288.1
See application file for complete search history.

(56) References Cited

U.S. PATENT DOCUMENTS

| | | | | |
|---|---|---|---|---|
| 749,834 | A | 1/1904 | Beisel | |
| 1,865,485 | A * | 7/1932 | Sas | 206/453 |
| 2,004,626 | A | 6/1935 | Hann | |
| 2,266,181 | A | 12/1941 | Epps | |
| D192,385 | S | 3/1962 | Anderson | |
| 3,049,260 | A | 8/1962 | Stone | |
| 3,073,439 | A | 1/1963 | Symmonds, Jr. | |
| 3,152,693 | A | 10/1964 | Anderson | |
| 3,199,709 | A | 8/1965 | Morrison et al. | |
| 3,203,726 | A | 8/1965 | Smith | |
| 3,416,652 | A | 12/1968 | Almasy | |
| 3,536,245 | A | 10/1970 | Palmer | |
| D225,829 | S | 1/1973 | Szabo | |
| 3,908,850 | A | 9/1975 | Jureit et al. | |
| 3,946,868 | A * | 3/1976 | Rutter | 206/453 |
| 3,955,677 | A | 5/1976 | Collingwood | |
| 4,063,702 | A * | 12/1977 | Wilde et al. | 248/345.1 |
| 4,120,441 | A * | 10/1978 | Hurley | 206/586 |
| 4,201,138 | A | 5/1980 | Cox | |
| 4,202,449 | A * | 5/1980 | Bendt | 206/453 |
| 4,244,471 | A | 1/1981 | Plante | |

(Continued)

*Primary Examiner*—Bryon P. Gehman
(74) *Attorney, Agent, or Firm*—Schwartz & Weinrieb

(57) ABSTRACT

An edge or corner protector comprises side surface portions which are adapted to be spaced from the external side surface portions of an article or appliance which define an external corner or edge region of the article or appliance to be protected, and an interior corner or apex region which is likewise adapted to be spaced from the external corner or edge region of the article or appliance. In this manner, not only does the corner or edge protector serve to protect the external corner or edge region of the article or appliance, but in addition, the spacing of the side surface portions of the new and improved edge or corner protector from the external side surface portions of the article or appliance, as well as the spacing of the interior corner or apex region of the corner or edge protector from the external corner or edge region of the article or appliance will effectively serve as a shock absorber so as to prevent external impact forces, impressed upon the carton or shipping container, from being transmitted internally onto the external side surface portions of the article or appliance, or onto the corner or edge region of the article or appliance.

15 Claims, 2 Drawing Sheets

U.S. PATENT DOCUMENTS 4,265,184 A 5/1981 Cox
4,292,901 A 10/1981 Cox
4,399,915 A 8/1983 Sorenson
4,482,054 A 11/1984 Gardner
4,483,444 A * 11/1984 Gardner ..... 206/320
4,496,054 A 1/1985 Koltun
4,714,163 A 12/1987 Reeves
4,742,916 A 5/1988 Galea
4,771,893 A 9/1988 Liebel
4,852,318 A * 8/1989 Anderson ..... 52/288.1
4,871,063 A 10/1989 Kumbier
4,874,095 A 10/1989 Warych
4,877,673 A 10/1989 Eckel et al.
4,899,888 A 2/1990 Shawler
5,040,684 A 8/1991 Knowles
5,048,689 A 9/1991 McFarland
5,056,664 A 10/1991 Demers
5,131,541 A 7/1992 Liebel
5,149,575 A * 9/1992 Soifer ..... 248/345.1
5,161,692 A 11/1992 Knierim
5,175,041 A 12/1992 Webb et al.
5,181,611 A 1/1993 Liebel
D336,033 S 6/1993 Welsh
5,267,651 A 12/1993 Hughes
5,277,310 A 1/1994 Mertz
5,307,928 A 5/1994 Bishop
5,385,236 A 1/1995 Cowan et al.
5,813,537 A 9/1998 DeReu et al.
5,918,800 A 7/1999 Goshorn et al.
6,044,601 A * 4/2000 Chmela et al. ..... 52/287.1
6,234,314 B1 5/2001 Qiu et al.
6,261,653 B1 * 7/2001 Smith ..... 206/586
6,286,683 B1 * 9/2001 Hunt et al. ..... 206/586
6,527,119 B1 3/2003 Markert et al.
7,048,118 B2 * 5/2006 Baechle ..... 206/320

* cited by examiner

SPACER AND SHOCK-ABSORBER TYPE ANGLEBOARD EDGE OR CORNER PROTECTOR

FIELD OF THE INVENTION

The present invention relates generally to angleboard edge or corner protectors for protecting the edge or corner regions of individual packages, fragile articles or products, palletized loads, appliances, and the like, and more particularly to a new and improved angleboard edge or corner protector which not only protectively surrounds or envelops an edge or corner region of an individual package, fragile article or product, appliance, palletized load, or the like, but, in addition, spaces the side surfaces, as well as the corner or edge region of the individual package, fragile article or product, appliance, palletized load, or the like, from the interior side surface portions and the corner regions of the carton or shipping container within which the individual package, fragile article or product, appliance, palletized load, or the like is disposed or contained whereby the new and improved angleboard edge or corner protector effectively serves as a shock absorber so as to maintain the individual package, fragile article or product, appliance, palletized load, or the like properly disposed or contained at its original predetermined position within the carton or shipping container, the new and improved angleboard edge or corner protector also simultaneously exhibiting a requisite amount of structural integrity and strength such that the protective functions of the new and improved angleboard edge or corner protector are not compromised.

BACKGROUND OF THE INVENTION

Package, article, palletized load, or appliance edge or corner protectors, corner post supports, and the like, are of course well-known in the packaging and shipping industries, and are accordingly widely used in connection with the shipping and transportation of various packages, articles, products, palletized loads, appliances, and the like, in order to protect the same during transit, wherein it is particularly desirable to protect the external corner or edge portions or regions thereof. Typical or conventional edge or corner protectors, or corner post supports, are disclosed, for example, within U.S. Pat. No. 6,527,119 which issued to Markert et al. on Mar. 4, 2003, U.S. Pat. No. 5,918,800 which issued to Goshorn et al. on Jul. 6, 1999, U.S. Pat. No. 5,307,928 which issued to Bishop on May 3, 1994, U.S. Pat. No. 5,181,611 which issued to Liebel on Jan. 26, 1993, U.S. Pat. No. 5,175,041 which issued to Webb et al. on Dec. 29, 1992, U.S. Pat. No. 5,161,692 which issued to Knierim on Nov. 10, 1992, U.S. Pat. No. 5,131,541 which issued to Liebel on Jul. 21, 1992, U.S. Pat. No. 5,048,689 which issued to McFarland on Sep. 17, 1991, U.S. Pat. No. 4,771,893 which issued to Liebel on Sep. 20, 1988, U.S. Pat. No. 4,399,915 which issued to Sorenson on Aug. 23, 1983, U.S. Pat. No. 3,955,677 which issued to Collingwood on May 11, 1976, and U.S. Pat. No. 3,536,245 which issued to Palmer on Oct. 27, 1970.

It is noted that all of the aforenoted patented implements are basically similar to each other, and representative of conventional corner or edge protectors, in that the same comprise at least two leg structures disposed at 90° with respect to each other so as to effectively define an interior region within which the external corner or edge region or portion of the particular article, product, package, appliance, or palletized load, to be protected, is adapted to be disposed.

It is noted, however, that while each one of the aforenoted corner or edge protectors does in fact protect the external corner or edge region of the particular article, product, package, appliance, or palletized load, and may even space the external side surface portions of the article, product, package, palletized load, or appliance from the interior side surface portions of the carton or shipping container within which the particular article, product, package, appliance, or palletized load is disposed, as exemplified by means of the aforenoted patent to Palmer, it is additionally noted that the external corner or apex region of the particular article, product, package, appliance, or palletized load is in fact disposed in direct contact with the interior corner or apex region of the corner or edge protector along, for example, the vertically oriented lineal extent thereof. Accordingly, if, for example, external impact forces are impressed upon the external corner or edge portion of the carton or shipping container, such impact forces will be transmitted directly to the external corner or edge portion of the particular article, product, package, appliance, or palletized load whereby damage to the external corner or edge portion of the particular article, product, package, appliance, or palletized load could be experienced.

A need therefore exists in the art for a new and improved corner or edge protector wherein not only are the external corner or edge regions of an article, product, appliance, package, or palletized load protected, but in addition, the external side surfaces, and the external corner or edge regions, of the article, product, package, appliance, or palletized load are respectively spaced from the internal side surfaces, and the internal corner region, of the carton or shipping container such that not only can the effects of externally impressed impact forces to the carton or shipping container be substantially prevented from being transmitted to the article, product, package, appliance, or palletized load, but in addition, the structural integrity and compression strength characteristics of the corner or edge protector can simultaneously be preserved.

SUMMARY OF THE INVENTION

The foregoing and other objectives are achieved in accordance with the teachings and principles of the present invention through the provision of a new and improved edge or corner protector which has a unique cross-sectional configuration, such as, for example, that resembling a wishbone, although other configurations, such as, for example, a semi-cylinder, a semi-ellipse, or a horseshoe, are equally serviceable. Accordingly, when the new and improved edge or corner protector is disposed around the external corner or edge region of an article, product, package, appliance, or palletized load, the distal end portions of the new and improved edge or corner protector will be disposed in contact with those external side surface portions of the article, product, package, appliance, or palletized load which define the external corner or edge region of the article, product, package, appliance, or palletized load, the side surface portions of the new and improved edge or corner protector, which come together and meet at the apex portion of the new and improved edge or corner protector, will be spaced from the external side surface portions of the article, product, package, appliance, or palletized load which define the external corner or edge region of the article, product, package, appliance, or palletized load, and the interior corner or apex region of the new and improved corner or edge protector will likewise be spaced from the external corner or edge region of the article, product, package, appliance, or palletized load.

In this manner, not only does the new and improved corner or edge protector serve to protect the external corner or edge region of the article, product, package, appliance, or palletized load, but in addition, the spacing of the side surface portions of the new and improved edge or corner protector from the external side surface portions of the article, product, package, appliance, or palletized load, as well as the spacing of the interior corner or apex region of the new and improved corner or edge protector from the external corner or edge region of the article, product, package, appliance, or palletized load will effectively serve as a shock absorber so as to prevent external impact forces, impressed upon the carton or shipping container, from being transmitted internally onto the external side surface portions of the article, product, package, appliance, or palletized load, or onto the corner or edge region of the article, product, package, appliance, or palletized load. The new and improved corner or edge protector may be fabricated from laminated paper, a suitable plastic material, or a laminated paper and plastic composite, and exhibits enhanced vertical compression strength which is an attribute in connection with the stacking of the cartons or shipping containers during shipping and storage.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
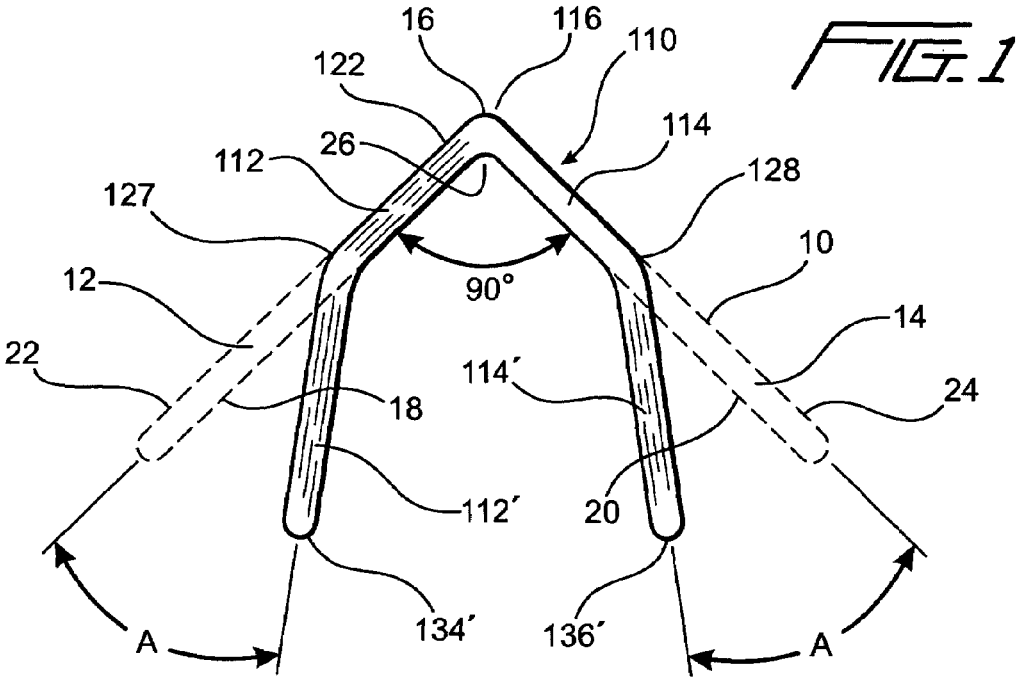
FIG. 1 is a schematic, end elevation view illustrating a first embodiment of a new and improved edge or corner protector, constructed in accordance with the principles and teachings of the present invention, wherein, as is shown in solid lines, the new and improved edge or corner protector has a substantially wish-bone shaped cross-sectional configuration as compared to a conventional, PRIOR ART edge or corner protector, as shown in dotted lines, which simply comprises a pair of leg members disposed 90° apart.

Referring now to the drawings, and more particularly to FIG. 1 thereof, a conventional, PRIOR ART edge or corner protector is illustrated in dotted lines and is generally indicated by the reference character 10. As can readily be appreciated, the conventional, PRIOR ART edge or corner protector 10 is seen to be substantially similar in its overall structure to each one of the edge or corner protectors as disclosed, for example, within the aforenoted patents to Markert et al. and Collingwood in that the edge or corner protector 10 is seen to comprise a pair of leg members 12,14 which are integrally connected together at an apex portion 16 and which are disposed at a predetermined angle of 90° with respect to each other. Accordingly, it can be perceived or appreciated that when the edge or corner protector 10 is disposed around an edge or corner region of an article, product, package, appliance, or palletized load, the internal surface portions 18,20 of the leg members 12,14 will be disposed in surface-to-surface contact with the external side surface portions of the article, product, package, appliance, or palletized load which form the edge or corner region upon which the edge or corner protector 10 is disposed, while the external surface portions 22,24 of the leg members 12,14 will be disposed in surface-to-surface contact with, for example, the internal side surface portions of a carton or shipping container within which the article, product, appliance, package, or palletized load is being transported.

Still further, the internal corner 26 of the apex portion 16 of the edge or corner protector 10 will be disposed in contact with the edge or corner region of the article, product, package, appliance, or palletized load along a lineal locus. Accordingly, still further, if, for example, external impact forces are impressed upon the external side surface portions, or upon the external corner or edge region, of the carton or shipping container, such impact forces will be transmitted directly to the external side surface portions, or to the external edge or corner region of the particular article, product, package, appliance, or palletized load whereby damage to the external side surface portions, or to the external corner or edge region, of the particular article, product, package, appliance, or palletized load could be experienced because no space or buffer zone is effectively created between the leg members 12,14 of the edge or corner protector 10 and the external side surface portions of the article, product, package, appliance, or palletized load, or between the internal corner 26 of the apex portion 16 of the edge or corner protector 10 and the edge or corner region of the article, product, package, appliance, or palletized load so as to effectively absorb the aforenoted shock or impact forces impressed upon the external side surface portions, or the external edge or corner region, of the carton or shipping container.

With reference continuing to be made to FIG. 1 wherein a new and improved edge or corner protector, developed in accordance with the principles and teachings of the present invention, is also disclosed and is generally indicated by the reference character 110, the aforenoted deficiences, characteristic of the conventional or PRIOR ART edge or corner protector 10, are effectively overcome. More particularly, it is seen that the new and improved edge or corner protector 110 of the present invention comprises a pair of primary leg members 112,114 which are integrally connected together, at proximal end portions thereof, at an apex region 116, and which are disposed at a predetermined angle of 90° with respect to each other, and a pair of secondary leg members 112',114' which are respectively integrally connected to distal end portions of the primary leg members 112,114 and which are effectively disposed or bent at a predetermined angle A with respect to the primary leg members 112,114. The angle A at which the pair of secondary leg members 112',114' are respectively disposed or bent with respect to the pair of primary leg members 112,114 may be within the range of 5°–45°, and accordingly, it can be appreciated that the new and improved edge or corner protector 110 has a substantially wishbone-shaped cross-sectional configuration. It is also to be appreciated that when the angle A is 45°, the secondary leg members 112',114' will be disposed substantially parallel, or at angle of 0° with respect to each other.

As a result of the aforenoted structure characteristic of the new and improved edge or corner protector 110 as disclosed within FIG. 1, several unique and novel operational features and structural characteristics are effectively implemented. For example, as a result of the aforenoted angular orientation of the secondary leg members 112', 114' with respect to the primary leg members 112,114, longitudinally oriented rib members 127,128 are effectively defined at the junctions or intersections defined between the primary leg members 112,114 and the secondary leg members 112',114'. These rib members 127,128 substantially enhance, for example, the vertical compression strength of the edge or corner protectors 110, and those of the cartons or shipping containers within which the articles, products, packages, appliances, or palletized loads are disposed, when, for example, multiple cartons or shipping containers are stacked atop one another. In addition, as can be further appreciated as a result of reference being made to FIG. 2, when the new and improved edge or corner protector 110 is used in connection with the protection of an external edge or corner region 130 of an article, product, package, appliance, or palletized load 132, it is seen that the distal end portions 134',136' of the secondary leg members 112',114' will be engaged with the external side surfaces 138,140 of the article, product, package, appliance, or palletized load 132 which are disposed upon opposite sides of the external edge or corner region 130 of the article, product, package, appliance, or palletized load 132.

In addition, the internal corner 126 of the apex portion 116 of the edge or corner protector 110 will be spaced from the external edge or corner region 130 of the article, product, package, appliance, or palletized load 132, as will be the internal surface portions 118,120 of the primary leg members 112,114 with respect to the external side surfaces 138,140 of the article, product, package, appliance, or palletized load 132, as denoted by means of the space S, as a result of the aforenoted angular orientation of the secondary leg members 112',114', with respect to the primary leg members 112,114, and the respective engagement of the distal end portions 134',136' of the secondary leg members 112',114' with the external side surfaces 138,140 of the article, product, package, appliance, or palletized load 132. Still yet further, it is also appreciated that the external surface portions 122,124 of the primary leg members 112, 114 will be disposed in direct contact with the internal surface portions 142,144 of side wall members 146,148 of a carton or shipping container 150 such that the apex region 116 of the edge or corner protector 110 will be stably disposed within the internal corner region 152 formed at the junction or intersection of the side wall members 146,148 of the carton or shipping container 150.

Accordingly, it can be readily appreciated that, as a result of the unique and novel structure characteristic of the new and improved corner or edge protector 110 of the present invention, when the new and improved edge or corner protector 110 of the present invention is disposed within the internal corner region 152 of the carton or shipping container 150, and when the new and improved corner or edge protector 110 of the present invention is also disposed around the external or edge region 130 of the article, product, appliance, package, or palletized load 132, the secondary leg members 112',114' will not only serve to respectively space the external surfaces 138,140 of the article, product, appliance, package, or palletized load 132 from the internal surfaces 142,144 of the shipping container or carton 150 and thereby create a buffer zone between such external and internal surfaces 138,140,142,144, but in addition, the secondary leg members 112',114' are somewhat flexible and resilient and will therefore be able to undergo flexure so as to effectively serve as shock absorbing structure when external impact forces are impressed upon, for example, the external surfaces 154,156 of the carton or shipping container 150, or upon the external corner region 158 of the carton or shipping container 158. In this manner, such external impact forces are not directly transmitted to, or impressed upon, the article, product, appliance, package, or palletized load 132, whereby the article, product, appliance, package, or palletized load 132 is accordingly protected. It is noted that in connection with the fabrication of the new and improved edge or corner protector 110, the new and improved edge or corner protector 110 may be fabricated either as a paperboard laminate, from a suitable plastic material, or as a paperboard/plastic composite. It is additionally noted that the new and improved edge or corner protector 110 may be fabricated so as to have various width dimensions, such as, for example, five inches (5.00") wide, six inches (6.00") wide, and the like, as measured between the distal end portions 134',136'. Still further, while the edge or corner protector 110, as illustrated within FIG. 1, is fabricated in such a manner that the length of each primary leg member 112,114 is substantially equal to the length of each secondary leg member 112',114' such that the rib members 127,128 are disposed substantially midway between the apex portion 116 and the distal end portions 134', 136' of the edge or corner protector 110. It is lastly noted that the thickness of each one of the primary and secondary leg members 112,114,112',114' may be within the range of 0.100–0.500 inches with the preferred thickness being approximately 0.180 inches.

Figure 3:
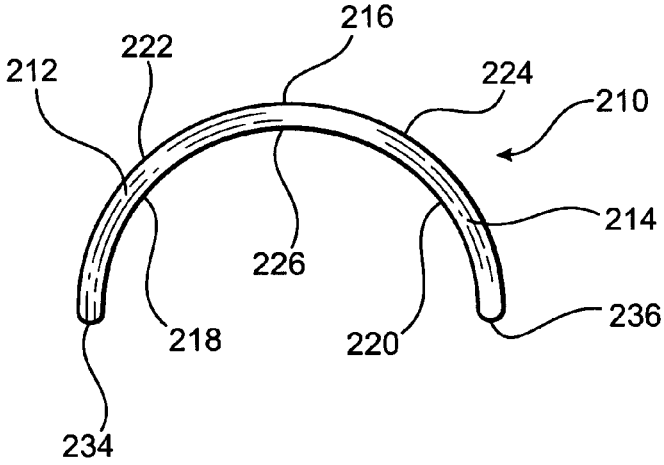
FIG. 3 is a schematic, end elevation view, similar to that of FIG. 1, illustrating, however, a second embodiment of a new and improved edge or corner protector, constructed in accordance with the principles and teachings of the present invention, wherein it is seen that this embodiment of the present invention has a substantially semi-cylindrical cross-sectional configuration.

With reference being made next to FIG. 3, a second embodiment of a new and improved edge or corner protector, constructed in accordance with the principles and teachings of the present invention, is disclosed and is generally indicated by the reference character 210. It is initially noted that the second embodiment edge or corner protector 210 is broadly similar to the first embodiment edge or corner protector 110, and therefore the discussion of the second embodiment edge or corner protector 210 will be confined to the differences which distinguish the second embodiment edge or corner protector 210 from the first embodiment edge or corner protector 110. Still further, it is also noted that those component parts of the second embodiment edge or corner protector 210 which correspond to the component parts of the first embodiment edge or corner protector 110 will be designated by corresponding reference numerals except that they will be within the 200 series. More particularly, it is seen that the primary difference comprising the second embodiment edge or corner protector 210, as compared to the first embodiment edge or corner protector 110, resides in the fact that in lieu of the first embodiment edge or corner protector 110, which is characterized by means of its wish-bone shaped cross-sectional configuration, the second embodiment edge or corner protector 210 has a substantially semi-cylindrical cross-sectional configuration. Accordingly, it can be appreciated that, in effect, the second embodiment edge or corner protector 210 comprises a pair of leg members 212,214 which are integrally connected together by means of a centrally located peak or apex region 216, and that the leg members 212,214 are respectively provided with distal end portions 234,236 which are disposed substantially parallel to each other.

Figure 2:
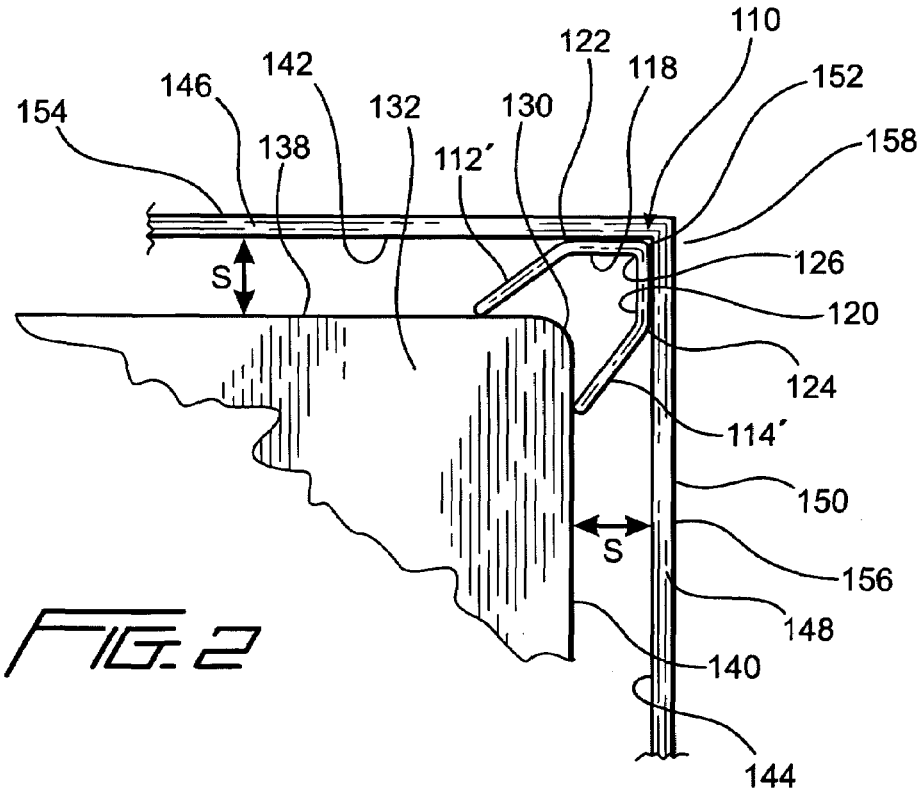
FIG. 2 is a schematic, top plan view showing the disposition of the first embodiment of the new and improved corner or edge protector of the present invention as illustrated within FIG. 1 and as utilized in connection with an appliance or product so as to protect a corner or edge region of the appliance or product while spacing the external side surfaces of the appliance or product from the internal side surfaces of the carton or shipping container, as well as spacing the corner or edge region of the appliance or product from the internal corner or apex of the new and improved corner or edge protector whereby the new and improved corner or edge protector can effectively serve as a spacer, buffer, or shock absorber for preventing the transmission of external impact forces, impressed upon the external side surfaces or corner or edge regions of the carton or shipping container from being transmitted directly to the appliance or product.

It can therefore be appreciated that if the second embodiment edge or corner protector 210 was utilized internally within the carton or shipping container 150 in conjunction with the external corner region 130 of the article, appliance, product, package, or palletized load 132, in lieu of the first embodiment edge or corner protector 110 as illustrated within FIG. 2, then the apex or peak region 216 of the second embodiment edge or corner protector 210 would be disposed within the internal corner region 152 of the carton or shipping container 150, the external surface portions 222, 224 of the second embodiment edge or corner protector 210 would be respectively disposed in contact with the internal surface portions 142,144 of the carton or shipping container 150, and the distal end portions 234,236 of the second embodiment edge or corner protector 210 would be respectively disposed in contact with the external surface portions 138,140 of the article, product, appliance, package, or palletized load 132.

Accordingly, as was the case with the first embodiment edge or corner protector 110, the external surface portions 138,140 of the article, product, appliance, package, or palletized load 132 would be stably disposed in a spaced mode with respect to the internal surface portions 142,144 of the carton or shipping container 150, as would the external edge or corner region 130 of the article, product, appliance, package, or palletized load 132 with respect to the internal corner region 152 of the carton or shipping container 150. In this manner, the second embodiment edge or corner protector 210 can effectively serve as a spacer and shock absorber with respect to external impact forces impressed upon the carton or shipping container 150 whereby such external impact forces cannot be detrimentally impressed upon the side surface portions 138,140, or upon the external edge or corner region 130, of the article, product, appliance, package, or palletized load 132, in a manner similar to that achieved by means of the first embodiment edge or corner protector 110.

Figure 4:
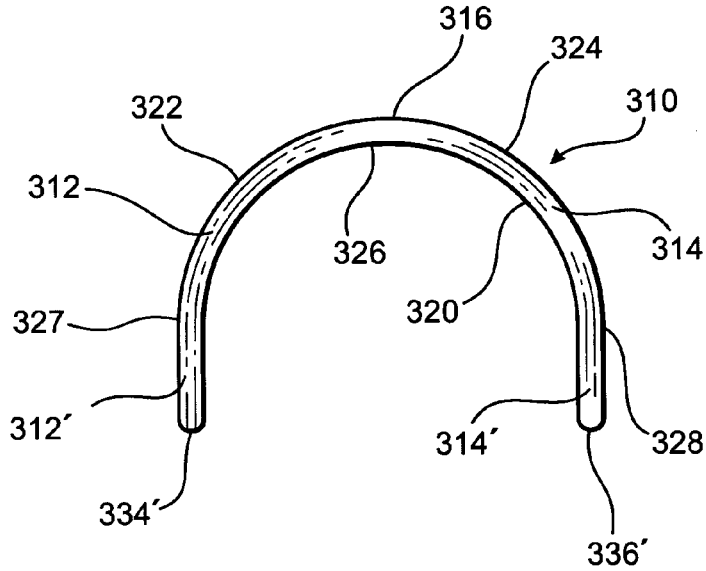
FIG. 4 is a schematic, end elevation view, similar to those of FIGS. 1 and 3, illustrating, however, a third embodiment of a new and improved edge or corner protector, constructed in accordance with the principles and teachings of the present invention, wherein it is seen that this embodiment of the present invention edge or corner protector has a substantially semi-elliptical cross-sectional configuration.

With reference being made next to FIG. 4, a third embodiment of a new and improved edge or corner protector, also constructed in accordance with the principles and teachings of the present invention, is disclosed and is generally indicated by the reference character 410. It is initially noted that the third embodiment edge or corner protector 310 is broadly similar to the first and second embodiment edge or corner protectors 110,210 and therefore the discussion of the third embodiment edge or corner protector 310 will be confined to the differences which distinguish the third embodiment edge or corner protector 310 from the first and second embodiment edge or corner protectors 110, 210. Still further, it is also noted that those component parts of the third embodiment edge or corner protector 310 which correspond to the component parts of the first and second embodiment edge or corner protectors 110,210 will be designated by corresponding reference numerals except that they will be within the 300 series. More particularly, it is seen that the primary difference comprising the third embodiment edge or corner protector 310, as compared to the first and second embodiment edge or corner protectors 110,210 resides in the fact that in lieu of the first and second embodiment edge or corner protectors 110,210 which are characterized respectively by means of the aforenoted wish-bone and semi-cylindrical shaped cross-sectional configurations, the third embodiment edge or corner protector 310 has a substantially semi-elliptical cross-sectional configuration. Accordingly, it can be appreciated that, in effect, the third embodiment edge or corner protector 310 comprises a pair of primary leg members 312,314 which are integrally connected together by means of a centrally located peak or apex region 316, and a pair of secondary leg members 312', 314' which are disposed parallel to each other. The secondary leg members 312',314' are respectively provided with distal end portions 334',336', and the integral interconnections defined between the primary leg members 312,314 and the secondary leg members 312',314' effectively define longitudinally extending rib members 327,328. It can therefore be appreciated further that if the third embodiment edge or corner protector 310 was utilized internally within the carton or shipping container 150 in conjunction with the external corner region 130 of the article, product, appliance, package, or palletized load 132, in lieu of the first embodiment edge or corner protector 110 as illustrated within FIG. 2, then the apex or peak region 316 of the third embodiment edge or corner protector 310 would be disposed within the internal corner region 152 of the carton or shipping container 150, the external surface portions 322,324 of the third embodiment edge or corner protector 310 would be respectively disposed in contact with the internal surface portions 142,144 of the carton or shipping container 150, and the distal end portions 334',336' of the third embodiment edge or corner protector 310 would be respectively disposed in contact with the external surface portions 138,140 of the article, product, appliance, package, or palletized load 132.

Accordingly, as was the case with the first embodiment edge or corner protector 110, the external surface portions 138,140 of the article, product, appliance, package, or palletized load 132 would be stably disposed in a spaced mode with respect to the internal surface portions 142,144 of the carton or shipping container 150, as would the external edge or corner region 130 of the article, product, appliance, package, or palletized load 132 with respect to the internal corner region 152 of the carton or shipping container 150. In this manner, the third embodiment edge or corner protector 310 can effectively serve as a spacer and shock absorber with respect to external impact forces impressed upon the carton or shipping container 150 whereby such external impact forces cannot be detrimentally impressed upon the side surface portions 138,140, or upon the external edge or corner region 130, of the article, product, appliance, package, or palletized load 132, in a manner similar to that achieved by means of the first and second embodiment edge or corner protectors 110,210.

Figure 5:
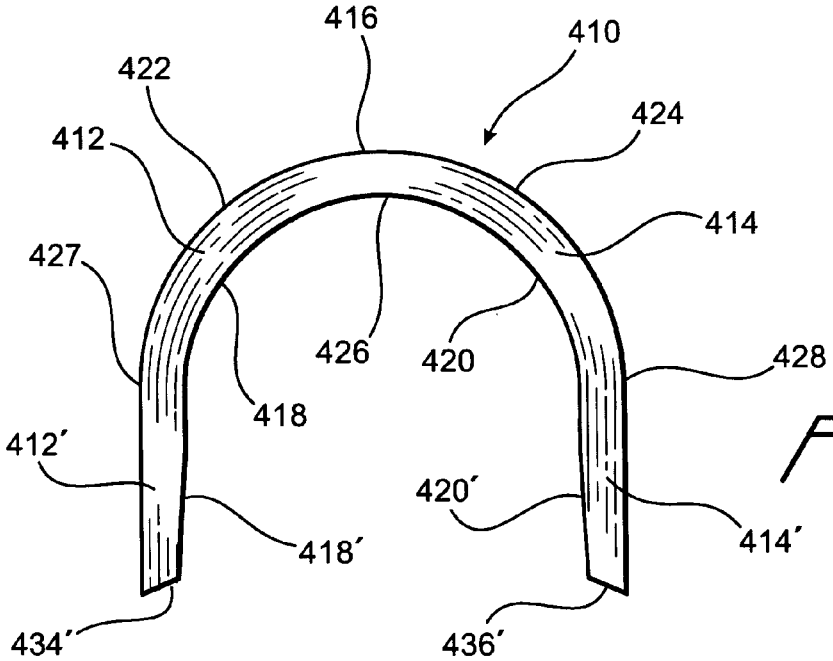
FIG. 5 is a schematic, end elevation view, similar to those of FIGS. 1,3 and 4, illustrating, however, a fourth embodiment of a new and improved edge or corner protector, constructed in accordance with the principles and teachings of the present invention, wherein it is seen that this embodiment of the present invention edge or corner protector has a substantially horseshoe shaped cross-sectional configuration.

With reference lastly being made to FIG. 5, a fourth embodiment of a new and improved edge or corner protector, also constructed in accordance with the principles and teachings of the present invention, is disclosed and is generally indicated by the reference character 410. It is initially noted that the fourth embodiment edge or corner protector 410 is essentially similar to the third embodiment edge or corner protector 310 and therefore the discussion of the fourth embodiment edge or corner protector 410 will be confined to the differences which distinguish the fourth embodiment edge or corner protector 410 from the third embodiment edge or corner protector 310. Still further, it is also noted that those component parts of the fourth embodiment edge or corner protector 410 which correspond to the component parts of the third embodiment edge or corner protector 310 will be designated by corresponding reference numerals except that they will be within the 400 series. More particularly, it is seen that the primary difference comprising the fourth embodiment edge or corner protector 410, as compared to the third embodiment edge or corner protector 310 resides in the fact that in lieu of the substantially elliptically shaped edge or corner protector 310, the fourth embodiment edge or corner protector 410 has a substantially horseshoe-shaped cross-sectional configuration. In particular, it can be appreciated that, in effect, the fourth embodiment edge or corner protector 410 comprises a pair of primary leg members 412,414 which are integrally connected together by means of a centrally located peak or apex region 416, and a pair of secondary leg members 412',414' which are disposed substantially parallel to each other, although it is noted that the internal surface portions 418', 420' of the secondary leg members 412',414' are tapered slightly as is characteristic of a horseshoe. In addition, the secondary leg members 412',414' are also respectively provided with distal end portions 434',436' which are angled outwardly.

It can therefore be appreciated that if the fourth embodiment edge or corner protector 410 was utilized internally within the carton or shipping container 150 in conjunction with the external corner region 130 of the article, appliance, product, package, or palletized load 132, in lieu of the first embodiment edge or corner protector 110 as illustrated within FIG. 2, then the apex or peak region 416 of the fourth embodiment edge or corner protector 410 would be disposed within the internal corner region 152 of the carton or shipping container 150, the external surface portions 422, 424 of the fourth embodiment edge or corner protector 410 would be respectively disposed in contact with the internal surface portions 142,144 of the carton or shipping container 150, and the angled distal end portions 434', 436' of the fourth embodiment edge or corner protector 410 would be respectively stably disposed in surface contact with the external surface portions 138,140 of the article, product, appliance, package, or palletized load 132. Accordingly, as was the case with the first embodiment edge or corner protector 110, the external surface portions 138,140 of the article, product, appliance, package, or palletized load 132 would be stably disposed in a spaced mode with respect to the internal surface portions 142,144 of the carton or shipping container 150, as would the external edge or corner region 130 of the article, product, appliance, package, or palletized load 132 with respect to the internal corner region 152 of the carton or shipping container 150. In this manner, the fourth embodiment edge or corner protector 410 can effectively serve as a spacer and shock absorber with respect to external impact forces impressed upon the carton or shipping container 150 whereby such external impact forces cannot be detrimentally impressed upon the side surface portions 138,140, or upon the external edge or corner region 130, of the article, product, appliance, package, or palletized load 132, in a manner similar to that achieved by means of the first, second, and third embodiment edge or corner protectors 110,210,310.

Thus, it may be seen that in accordance with the principles and teachings of the present invention, there has been provided a new and improved edge or corner protector which is adapted to be disposed around the external corner or edge region of an article, product, package, appliance, or palletized load such that the side surface portions of the new and improved edge or corner protector will be spaced from the external side surface portions of the article, product, package, appliance, or palletized load which define the external corner or edge region of the article, product, package, appliance, or palletized load. In a similar manner, the interior corner or apex region of the new and improved corner or edge protector will likewise be spaced from the external corner or edge region of the article, product, package, appliance, or palletized load.

In this manner, not only does the new and improved corner or edge protector serve to protect the external corner or edge region of the article, product, appliance, package, or palletized load, but in addition, the spacing of the side surface portions of the new and improved edge or corner protector from the external side surface portions of the article, product, package, appliance, or palletized load, as well as the spacing of the interior corner or apex region of the new and improved corner or edge protector from the external corner or edge region of the article, product, package, appliance, or palletized load will effectively serve as a shock absorber so as to prevent external impact forces, impressed upon the carton or shipping container, from being transmitted internally onto the external side surface portions of the article, product, package, appliance, or palletized load, or onto the corner or edge region of the article, product, package, appliance, or palletized load. In this manner, the external side surface portions of the article, product, package, appliance, or palletized load, and the corner or edge region of the article, product, package, appliance, or palletized load are in fact protected against substantial damage.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An external corner edge protector for protecting an external corner edge portion of an article when said external corner edge protector is disposed around the external corner edge portion of the article, comprising:

a pair of leg members, having a predetermined longitudinal extent, and internal and external surface portions integrally connected together by means of an apex portion having an internal corner region and an external corner region;

wherein said pair of leg members comprise proximal end portions which are disposed adjacent to, and are integrally connected with, said apex portion, and distal end portions which are disposed remote from said apex portion and which are disposed at an angle, which is less than 90°, with respect to each other such that when said external corner edge protector is disposed around the external corner edge portion of the article, defined by side surfaces of the article which intersect each other and thereby define the external corner edge portion of the article, so as to protect the external corner edge portion of the article, said distal end portions of said external corner edge protector are the only portions of said external corner edge protector that will engage the side surfaces of the article so as to respectively space said internal corner region of said apex portion from the external corner edge portion of the article, and internal surface portions of said leg members from the side surfaces of the article so as to stably and resiliently support the article within a corner region of a shipping container.

2. The external corner edge protector as set forth in claim 1, wherein:

said external corner edge protector has a cross-sectional configuration which is selected from the group comprising a wish-bone, a semi-circle, a semi-ellipse, and a horse shoe.

3. The external corner edge protector as set forth in claim 2, wherein:

said external corner edge protector, having any one of said wish-bone, semi-circle, semi-ellipse, and horse shoe cross-sectional configurations, has said distal end portions disposed at a predetermined angle with respect to said proximal end portions such that longitudinally extending reinforcing rib members are defined at intersection locations between said distal end portions and said proximal end portions of said leg members.

4. The external corner edge protector as set forth in claim 3, wherein:

said predetermined angle, defined between each one of said distal end portion and said proximal end portion of each leg member is within the range of 5°–45°.

5. The external corner edge protector as set forth in claim 1, wherein:

said external corner edge protector is fabricated from a material selected from the group comprising a paperboard laminate, a plastic, and a paper-plastic composite.

6. An external corner edge protector for protecting an external corner edge portion of an article when said external corner edge protector is disposed around the external corner edge portion of the article, comprising:

a pair of leg members, having a predetermined longitudinal extent, and internal and external surface portions, integrally connected together by means of an apex portion having an internal corner region and an external corner region;

wherein said pair of leg members comprise proximal end portions which are disposed adjacent to, and are integrally connected with, said apex portion, and distal end portions which are disposed remote from said apex portion and which are disposed at an angle, which is less than 90°, with respect to each other such that when said external corner edge protector is disposed around the external corner edge portion of the article, defined by side surfaces of the article which intersect each other and thereby define the external corner edge portion of the article, so as to protect the external corner edge portion of the article, said distal end portions of said external corner edge protector are the only portions of said external corner edge protector that will engage the side surfaces of the article so as to respectively space said internal corner region of said apex portion from the external corner edge portion of the article, and internal surface portions of said leg members from the side surfaces of the article, while external surface portions of said leg members can engage internal surface portions of a shipping container whereby impact forces impressed upon external surface portions of the shipping container will not be directly transmitted to either one of the external corner edge portion, and the side surfaces, of the article.

7. The external corner edge protector as set forth in claim 6, wherein:

said external corner edge protector has a cross-sectional configuration which is selected from the group comprising a wish-bone, a semi-circle, a semi-ellipse, and a horse shoe.

8. The external corner edge protector as set forth in claim 7, wherein:

said external corner edge protector, having any one of said wish-bone, semi-circle, semi-ellipse, and horse shoe cross-sectional configurations, has said distal end portions disposed at a predetermined angle with respect to said proximal end portions such that longitudinally extending reinforcing rib members are defined at intersection locations between said distal end portions and said proximal end portions of said leg members.

9. The external corner edge protector as set forth in claim 8, wherein:

said predetermined angle, defined between each one of said distal end portion and said proximal end portion of each leg member is within the range of 5°–45°.

10. The external corner edge protector as set forth in claim 6, wherein:

said external corner edge protector is fabricated from a material selected from the group comprising a paperboard laminate, a plastic, and a paper-plastic composite.

11. An external corner edge protector for protecting an external corner edge portion of an article when said external corner edge protector is disposed around the external corner edge portion of the article, comprising:

a pair of leg members, having a predetermined longitudinal extent, and internal and external surface portions, integrally connected together by means of an apex portion having an internal corner region and an external corner region;

wherein said pair of leg members comprise proximal end portions which are disposed adjacent to, and are integrally connected with, said apex portion, and distal end portions which are disposed remote from said apex portion and which are disposed at an angle, which is less than 9°, with respect to each other such that when said external corner edge protector is disposed around the external corner edge portion of the article, defined by side surfaces of the article which intersect each other and thereby define the external corner edge portion of the article, so as to protect the external corner edge portion of the article, said distal end portions of said external corner edge protector are the only portions of said external corner edge protector that will engage the side surfaces of the article so as to respectively space said internal corner region of said apex portion from the external corner edge portion of the article, and internal surface portions of said leg members from the side surfaces of the article, while external surface portions of said leg members can engage internal surface portions of a shipping container whereby said external corner edge protector serves as a shock absorber so as to effectively absorb impact forces impressed upon external surface portions of the shipping container and thereby prevent such impact forces from being directly transmitted to either one of the external corner edge portion, and the side surfaces, of the article.

12. The external corner edge protector as set forth in claim 11, wherein:

said external corner edge protector has a cross-sectional configuration which is selected from the group comprising a wish-bone, a semi-circle, a semi-ellipse, and a horse shoe.

13. The external corner edge protector as set forth in claim 12, wherein:

said external corner edge protector, having any one of said wish-bone, semi-circle, semi-ellipse, and horse shoe cross-sectional configurations, has said distal end portions disposed at a predetermined angle with respect to said proximal end portions such that longitudinally extending reinforcing rib members are defined at intersection locations between said distal end portions and said proximal end portions of said leg members.

14. The external corner edge protector as set forth in claim 13, wherein:

said predetermined angle, defined between each one of said distal end portion and said proximal end portion of each leg member is within the range of 5°–45°.

15. The external corner edge protector as set forth in claim 11, wherein:

said external corner edge protector is fabricated from a material selected from the group comprising a paperboard laminate, a plastic, and a paper-plastic composite.

* * * * *